US005855367A

United States Patent [19]

Inoue et al.

[11] Patent Number: 5,855,367

[45] Date of Patent: Jan. 5, 1999

[54] SHEET INVERTING DEVICE

[75] Inventors: Tatsuya Inoue, Nara; Yoshitaka Okahashi, Kashihara, both of Japan

[73] Assignee: Sharp Kabushiki Kaisha, Osaka, Japan

[21] Appl. No.: 798,223

[22] Filed: Feb. 10, 1997

[30] Foreign Application Priority Data

Mar. 4, 1996 [JP] Japan ..... 8-045826

[51] Int. Cl.[6] ..... B65H 29/00

[52] U.S. Cl. ..... 271/186; 271/195

[58] Field of Search ..... 271/185, 186, 271/194, 195

[56] References Cited

U.S. PATENT DOCUMENTS

| | | | |
|---|---|---|---|
| 4,049,255 | 9/1977 | Stange et al. | 271/195 |
| 4,054,285 | 10/1977 | Stange et al. | 271/195 |
| 4,159,824 | 7/1979 | Stange et al. | 271/195 |
| 4,405,126 | 9/1983 | Frye et al. | 271/195 |
| 4,512,255 | 4/1985 | Crist . | |
| 4,834,361 | 5/1989 | Fenske et al. | 271/195 |

FOREIGN PATENT DOCUMENTS

| | | |
|---|---|---|
| 406827A1 | 1/1991 | European Pat. Off. . |
| 61-23146 | 6/1986 | Japan . |
| 62-126077 | 6/1987 | Japan . |

*Primary Examiner*—H. Grant Skaggs
*Attorney, Agent, or Firm*—Birch, Stewart, Kolasch & Birch, LLP

[57] ABSTRACT

A turning chamber is composed of upper and lower guides disposed vertically with a gap in between. An inputting device is provided in the upper position of the opening of the turning chamber while a discharging device is disposed in the lower portion of the opening of the turning chamber. The lower guide is inclined forming a down slope toward the discharging device. A fan is provided for sending air across the underside of the sheet as it is being inputted into the turning chamber. A duct is attached to the fan and is disposed between the inputting device and discharging device with the blower port thereof directed to the lower guide. The sheet inputted through the inputting device falls due to gravity whilst air is blown across the underside of the sheet so that the sheet can be accommodated into the turning chamber.

7 Claims, 5 Drawing Sheets

SHEET INVERTING DEVICE

BACKGROUND OF THE INVENTION (1) Field of the Invention

The present invention relates to a sheet inverting device for use in copiers and printers with an automatic duplex printing function, and in particular to a device for inverting the face of the sheet with one side printed.

(2) Description of the Prior Art

As an example of a sheet inverting device used in conventional copiers with an automatic duplex printing function, a configuration shown in FIG. 1 was disclosed in Japanese Patent Publication Sho 61 No.23,146. In this figure, a first roller or driving roller 1 is pressed against second and third rollers 2 and 3. A pair of shoot guides 4 and 5 oriented upwards are provided above the nip (B) between first and second rollers 1 and 2 and the nip (C) between first and third rollers 1 and 3, respectively. In this geometry, a sheet A is fed through the nip (B) into the pocket formed between the pair of shoot guides 4 and 5 to be held therebetween. Then, the rear end of sheet A is moved along the peripheral surface of first roller 1 so that it is caught at the nip (C) and delivered out through the nip, thus inverting sheet A.

There is another configuration as shown in FIG. 2. In this case, first, second and third rollers 1, 2 and 3 are arranged in a vertical configuration. A pair of shoot guides 4 and 5 are disposed horizontally, and a stopper 6 is provided at a position corresponding to the size of sheet A. In this geometry, sheet A is fed through the nip (B) into the pocket formed between the pair of shoot guides 4 and 5 to be held therebetween. Then, the rear end of sheet A is moved along the peripheral surface of first roller 1 so that it is caught at the nip (C) and delivered out through the nip, thus inverting sheet A.

The copy rate of a copier (the number of copies produced per min) is determined by the sheet feed speed and the sheet interval. If the sheet feed speed cannot be increased due to process requirements, the only thing which can be done for enhancing the copy rate is to shorten the sheet interval. In the case where the sheet interval is reduced, whilst one sheet is sent out from the sheet inverting device, the next sheet is fed into the sheet inverting device. As a result, two sheets pass each other inside the sheet inverting device. In such a case, the apparatus suffered from a problem in that the second sheet may touch the first sheet to be inverted and tends to roll up it causing paper jam.

Conventional apparatuses further suffered from a problem in that when a large sized sheet or a thin type sheet is conveyed into the shoot, the sheet tends to be attracted to the interior wall of the shoot due to electrostatic force, etc., thus the conveyance of the sheet is prevented causing paper jamming.

SUMMARY OF THE INVENTION

It is therefore an object of the present invention to provide a sheet inverting device which can invert the sheet without causing sheet jamming by preventing the sheet as it is being inputted, from touching other sheet or components.

The present invention has been devised in order to achieve the above object and the gist of the invention is as follows:

In accordance with a first aspect of the invention, a sheet inverting device includes: a turning chamber which temporarily holds a sheet for turning the sheet upside down; an inputting means which conveys the sheet into the turning chamber; a discharging means which takes the sheet out of turning chamber; and a blower means which sends air across the underside of the sheet as it is being inputted into the turning chamber, and is constructed so that the inputting means is disposed in the upper position of the opening of the turning chamber and the discharging means is disposed in the lower portion of the opening of the turning chamber so that the sheet as it is being inputted through the inputting means falls due to gravity and can be accommodated into the turning chamber.

A second aspect of the invention resides in a sheet inverting device having the first feature of the invention, wherein the turning chamber is composed of upper and lower guides disposed vertically with a gap in between, the lower guide being inclined forming a down slope toward the discharging means, and the blower means is composed of a fan and a duct attached to the fan, the duct being disposed between the inputting means and discharging means with the blower port thereof directed to the lower guide.

Third and fourth aspects of the invention reside in sheet inverting devices having the first and second features, respectively, wherein a wind intensity regulator is provided at the blower port of the blower means.

Fifth and sixth aspects of the invention reside in sheet inverting devices having the first and second features, respectively, wherein a vertical wind direction changing mechanism for changing wind in the vertical direction is provided at the blower port of the blower means.

Seventh and eighth aspects of the invention reside in sheet inverting devices having the first and second features, respectively, wherein a wind changing mechanism for changing wind in the sheet width direction is provided at the blower port of the blower means.

As has been described in the above, a means for solving the problem of the invention comprises: a sheet inverting device has a turning chamber which temporarily holds a sheet for turning the sheet upside down, an inputting means which conveys the sheet into the turning chamber and a discharging means which takes the sheet out of turning chamber. The inputting means is disposed in the upper position of the opening of the turning chamber and the discharging means is disposed in the lower portion of the opening of the turning chamber so that the sheet as it is being inputted through the inputting means falls due to gravity and can be accommodated into the turning chamber. Further, a blower means which sends air across the underside of the sheet as it is being inputted into the turning chamber is provided.

Further, the turning chamber is composed of upper and lower guides disposed vertically with a gap in between, the lower guide being inclined forming a down slope toward the discharging means. The blower means is composed of a fan and a duct attached to the fan, the duct being disposed between the inputting means and discharging means with the blower port thereof directed to the lower guide.

As a result, the air blown out from the duct is sent toward the underside of the sheet as it is being inputted from the upper portion of the turning chamber, so as to create an air layer between the inputted sheet and another sheet which is discharged from the lower portion of the turning chamber. Further, another air layer is created between the inputted sheet and the lower guide. In this way, it is possible to prevent the inputted sheet from touching the discharging sheet or components in the turning chamber.

A wind intensity regulator for regulating the wind intensity is provided at the blower port of blowing means. This wind intensity regulator enables switching between the activation and deactivation of blowing, and variation in the wind intensity. Thus, it is possible to send air optimally in accordance with the position of the sheet in the turning chamber, without adversely affecting the invention of the sheet, Further, a vertical wind direction changing mechanism for changing wind in the vertical direction is provided at the blower port of the blower means. Here, changing wind in the vertical direction means that the direction of air blow is directed upward or downward. That is, air is not only sent across the underside of the sheet but also it is sent downward so as to promote the falling of the sheet due to gravity.

Moreover, a wind changing mechanism for changing wind in the sheet width direction is provided at the blower port from the blower means. Here, changing wind in the sheet width direction means that the angle of wind is made greater so as to broaden the range of blowing with respect to the sheet width direction, or the angle is made smaller so as to narrow the range of blowing with respect to the sheet width direction so that wind can blow concentratively. It is possible to reliably prevent the sheet as it is being inputted, from touching the discharging sheet or components in the turning chamber, by broadening the blowing range of wind. It is also possible to promote the falling of the sheet due to gravity, by narrowing the blowing range of wind.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

Figure 1:
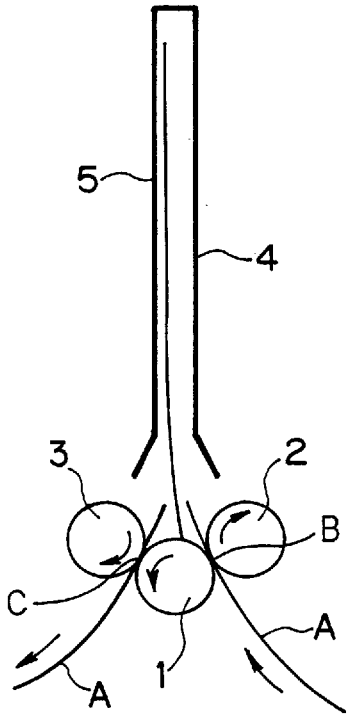
FIG. 1 PRIOR ART
FIG. 1 is a schematic view showing a conventional sheet inverting device.
Figure 2:
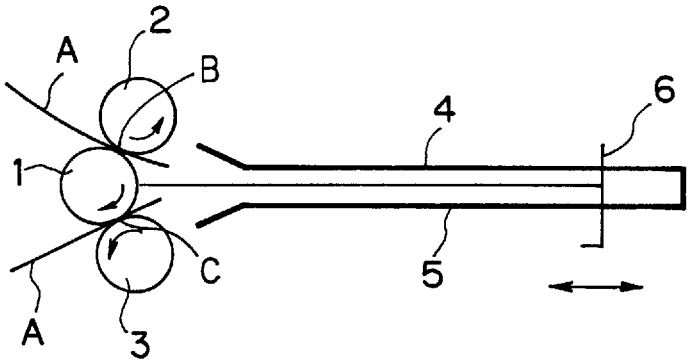
FIG. 2 PRIOR ART
FIG. 2 is a schematic view showing another conventional sheet inverting device.

DESCRIPTION OF THE PREFERRED EMBODIMENTS (First embodiment)

A sheet inverting device of this embodiment includes: a turning chamber 11 which temporarily holds a sheet A for turning sheet A upside down; an inputting means 12 which conveys sheet A into turning chamber 11; a discharging means 13 for taking sheet A out of turning chamber 11; a blower means 14 which sends air W from a space between inputting and discharging means 12 and 13 disposed above and below, along the underside of sheet A conveyed into turning chamber 11; and a controller for controlling the operations of means 12, 13 and 14 in time with the conveyance of sheet A. In this arrangement, the sheet A which is fed by inputting means 12 falls due to gravity thus being held in turning chamber 11.

Turning chamber 11 is composed of a pair of upper and lower guides 20 and 21 disposed vertically with a gap in between. These guides 20 and 21 are provided inclined from one end (the upper end) and to the other (the lower end). The inclination of the guides becomes gentle as they approach the lower end where an opening port 22 for admission and discharge of sheet A is formed. The lower end of lower guide 21 is extended further than that of upper guide 20. The lower end of the upper guide 20 is bent upward broadening opening port 22 of turning chamber 11.

Inputting means 12 is disposed above opening port 22 of turning chamber 11 and is composed of a pair of sheet entrance guides 23*a* and 23*b* for guiding sheet A with one side printed which comes from the fixing unit of the copier, downwards from the upper side to bring the sheet to the upper part of opening port 22 of turning chamber 11; a conveyer roller portion for conveying sheet A through the passage defined by sheet entrance guides 23*a* and 23*b;* and a conveyer belt portion disposed below sheet entrance guides 23*a* and 23*b*. The conveyer roller portion is composed of a driving and a driven roller 24 and 25 opposite one another. Driving roller 24 is rotated by an unillustrated motor. The conveyer belt portion is composed of a belt driving roller 26, a belt driven roller 27, a conveyer belt 28 wound therebetween and a belt driven roller 29 pressing against conveyer belt 28. Conveyer belt 28 may be composed of a single strip or a plurality of parallel strips arranged near the lower end of upper guide 20. Belt driving roller 26 is rotated by an unillustrated motor. In this geometry, sheet A is fed into turning chamber 11 from the conveyer belt portion and falls due to gravity onto lower guide 21. Here, rollers may be used in place of conveyer belt 28.

Discharging means 13 is disposed on the lower side of opening port 22 of turning chamber 11, and is composed of a discharging roller portion for taking out sheet A from turning chamber 11, and a pair of sheet discharge guides 30*a* and 30*b* for guiding discharged sheet A toward the photoreceptor. The discharging roller portion is composed of a driving roller 31 and a driven roller 32 opposite one another. Each of the rollers is made up of a plurality of roller pieces arranged across the width of the sheet. Driving roller 31 is rotated by an unillustrated motor. Lower sheet discharge guide 30*b* is formed continuous to lower guide 21. The discharging roller portion is disposed near the lower end of lower guide 21 so that when sheet A slides down along lower guide 21, it may abut driving roller 31. In this arrangement, sheet A is drawn into the discharging roller portion as driving roller 31 rotates.

Blower means 14 is composed of a fan 33 and a duct 34 attached to fan 33 and is disposed facing turning chamber 11. Duct 34 is disposed between conveyer belt 28 and sheet discharge guide 30*a* and is four-sided i.e., having upper and lower and left and right walls, and its blower port designated at 35 extends across the sheet width direction and is oriented toward lower guide 21. Here, since in each roller 31 and 32 in the discharging roller portion, the pieces of the roller are spaced at intervals across the sheet width direction, these rollers will not block wind W blowing from duct 34. As to wind W, the intensity is appropriately set so as not to prevent the falling of sheet A. Further, since wind W goes through openings at the upper end as well as through the opening on the sides of upper and lower guides 20 and 21, it will not be impeded inside turning chamber 11, and also will not blow away sheet A.

The controller is set to drive each of driving roller 24 in the conveyer roller portion, belt driving roller 26 in the conveyer belt portion, driving roller 31 in the discharging roller portion and fan 33 and also governs the control of each unit in the copier. Therefore, it is possible to drive the rollers 24, 26, 31 and fan 33 in time with the conveyance of sheet A.

In the above configuration, sheet A with one side printed, which is discharged from the fixing unit, is conveyed by the conveyer roller portion through the passage defined between sheet entrance guides 23*a* and 23*b* up to the conveyer belt portion, which in turn conveys it into turning chamber 11. After the rear end of sheet A is discharged from conveyer belt portion, the sheet A falls due to gravity and slides along lower guide 21. Subsequently, sheet A is delivered out from discharging roller portion, thus sheet A is turned up-side down.

Figure 3:
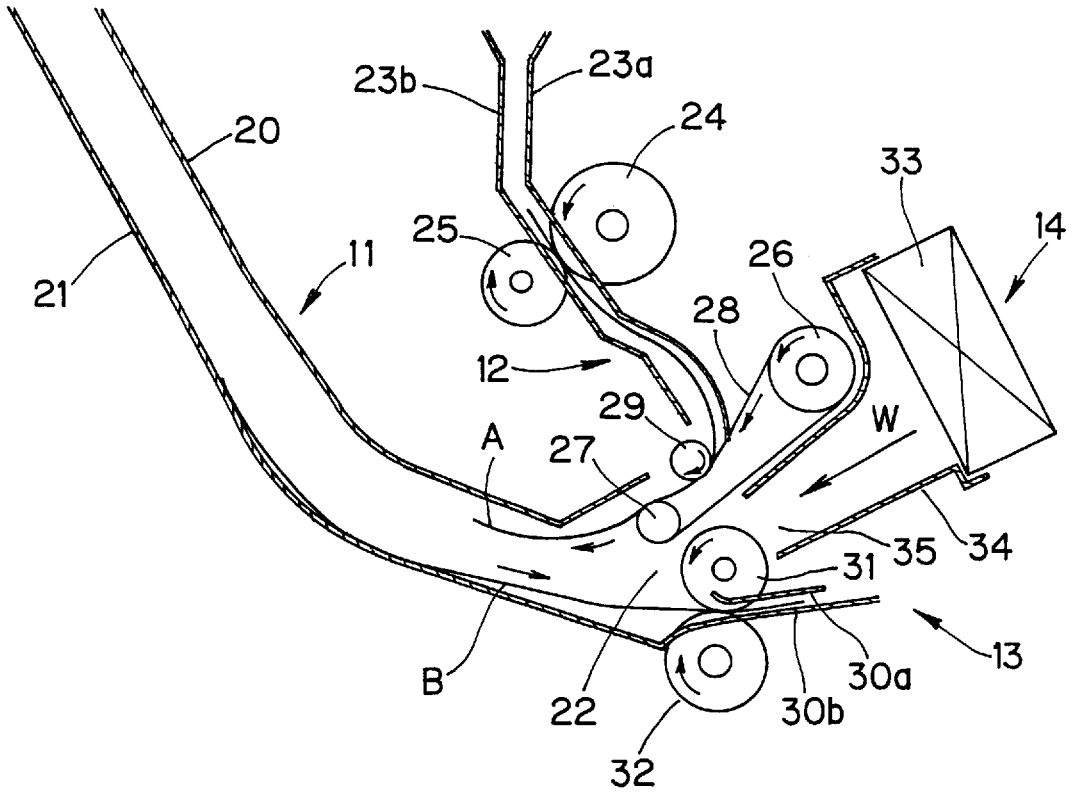
FIG. 3 is a configurational view showing a sheet inverting device in accordance with a first embodiment of the invention.

In this operation, if the distance from sheet A to the preceding sheet B is reduced in order to enhance the copy rate of the copier, the following sheet A is conveyed into turning chamber 11 while the preceding sheet B is being discharged from turning chamber 11. This situation is shown in FIG. 3. As a result, two sheets A and B pass each other inside turning chamber 11. In this situation, fan 33 is operated in synchronism with the operation of the conveyer belt portion for bringing sheet A into turning chamber 11 so as to send wind W through duct 34 toward the interior of turning chamber 11. This air flows along the undersurface of sheet A so as to create an air layer between the preceding sheet B and the following sheet A at the opening port 22 of turning chamber 11. Thus, the sheets can be separated from each other by air. Accordingly, the two sheets A and B can be smoothly conveyed in the opposite directions without touching each other. In this way, it is possible to prevent jamming which would occur when the preceding sheet B rolls up the following sheet A, enabling the reduction in the interval between one sheet and the next, which means improvement in the inversion of the sheets.

When sheet A is discharged from the conveyer belt portion, the operation of fan 33 may be stopped or the rotation of fan 33 may be reduced so as to lessen the intensity of the blow and thereby facilitate the sheet A to fall due to gravity. The timing of the operation control of fan 33 is determined based on the detection of the position of the sheet A conveyed and taking into account the timing of the operation of the conveyer belt portion.

Use of a large-sized sheet or thin sheet tends to generate electrostatic charge on the sheet. To deal with this, fan 33 can be operated during the conveyance of sheet A into turning chamber 11, so that air will be blown across the underside of sheet A to create an air layer between sheet A which is falling due to gravity and lower guide 21. As a result, sheet A can be separated from lower guide 21, thus preventing the sheet A from being attracted to lower guide 21 under the influence of static charge. In this way, it is possible to prevent sheet jamming, thus achieving high reliability of the inversion.

Japanese Patent Application Laid-Open Sho 62 No. 126, 077 discloses a technique in which the inverting portion for turning the sheet upside down is provided. In this inverting portion where the sheet is inputted and discharged by means of an inverting roller, an air nozzle is provided which sends air toward the space between the sheet which is being discharged from the inverting portion and the sheet which is being inputted thereto, in order to prevent contact between these sheets. In this case, however, it is possible to prevent contact between sheets, but the contact between the sheet and the inverting tray in the inverting portion can not be prevented since the entrance and discharge of sheets are effected by the inverting roller. Therefore, the sheet is blown onto the inverting tray, whereby it is attracted to the inverting tray due to electrostatic charge or other factors, resulting in jamming. In contrast to this, in accordance with the embodiment of the invention, the sheet falls inside the turning chamber due to gravity and the entrance and discharge of the sheet is effected by individual devices. Further, since air is blown along the undersurface of the sheet, an air layer is created below the sheet so that the sheet can be prevented from touching other components, thus making it possible to prevent occurrence of sheet jamming.

(Second embodiment)

Figure 4A:
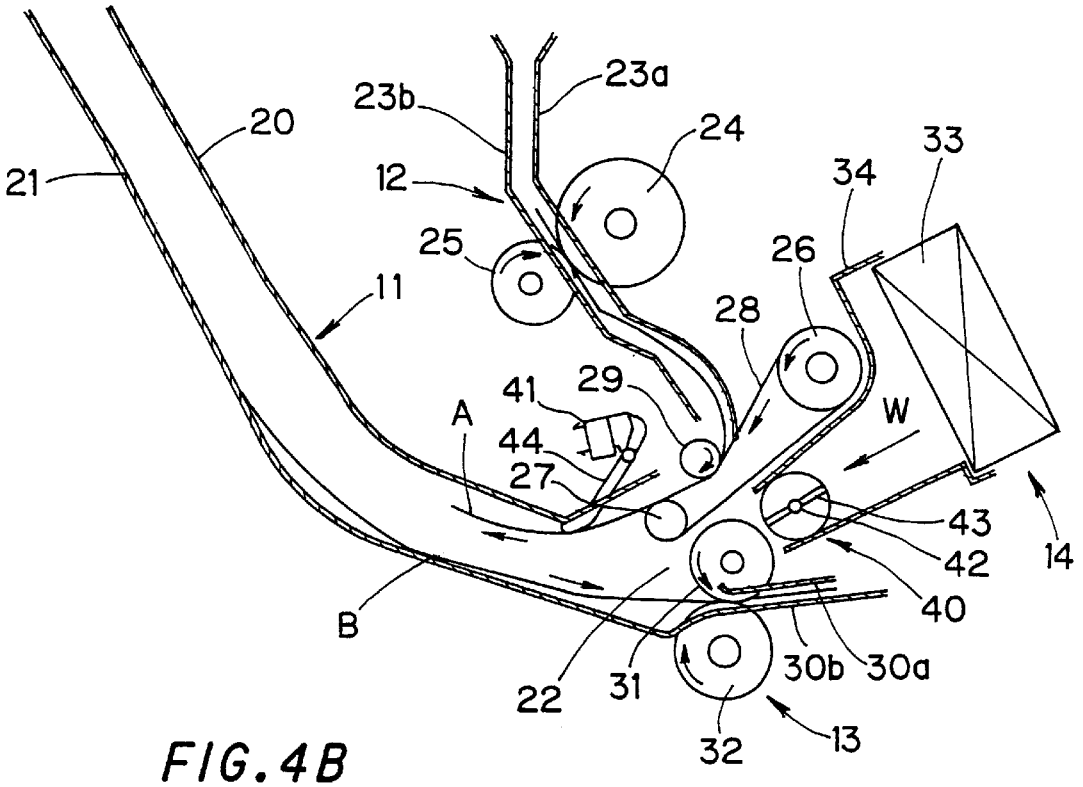
FIG. 4A is a configurational view showing a sheet inverting device in accordance with a second embodiment of the invention, where a sheet is inputted into the device.
Figure 4B:
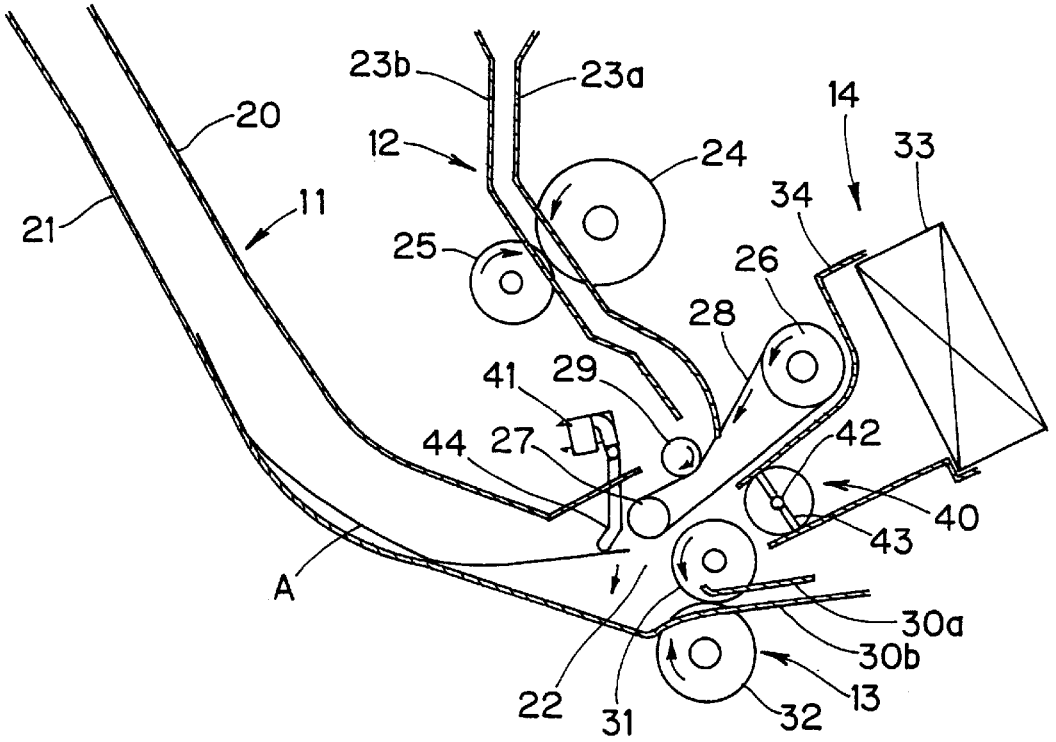
FIG. 4B is a configurational view showing a sheet inverting device in accordance with a second embodiment of the invention, where a sheet falls due to gravity.

As this embodiment shown in FIGS. 4A and 4B, a wind intensity regulator 40 for regulating the wind intensity is provided at blower port 35 of duct 34, so that the operation of wind intensity regulator 40 will be controlled by the controller on the basis of the output signal from a sheet sensor 41 for detecting the conveyance of sheet A. Other configurations are the same as those in the first embodiment.

Air intensity regulator 40 comprises a butterfly valve with its valve rod 42 rotatably supported by side walls of duct 34. As valve rod 42 is rotated by the motor, its valve 43 rotates so that blower port 35 of duct 34 will fully open or fully close.

Sheet sensor 41 is disposed on the lower end side of upper guide 20 so that its actuator 44 can come in contact with sheet A which was discharged from conveyer belt 28. In this geometry, actuator 44, as it oscillates, outputs an on-off signal. More specifically, when sheet A enters turning chamber 11, actuator 44 sways to turn on sheet sensor 41; when sheet A or the rear end of it is discharged from conveyer belt portion and falls due to gravity, actuator 44 separates from sheet A to turn off sheet sensor 41, whereby the conveyance position of sheet A is detected.

Then, when the preceding sheet B is discharged from turning chamber 11 and at the same time the following sheet A is inputted into turning chamber 11, two sheets A and B pass each other in turning chamber 11. In such a case, or in the case where a large-sized sheet or thin sheet is inputted into turning chamber 11, as sheet sensor 41 is turned on by passage of sheet A, wind intensity regulator 40 is operated as shown in FIG. 4A, so that blower port 35 becomes fully open and wind W from fan 33 is blown into turning chamber 11. This wind creates an air layer between the preceding sheet B and the following sheet A at opening port 22 of turning chamber 11, so that air separates these sheets from one another. Thus, it is possible to prevent occurrence of sheet jamming which would be caused when the following sheet A rolls up the preceding sheet B.

When a large-sized sheet or thin sheet is inputted, wind W is blown across the underside of sheet A so as to create an air layer between sheet A falling due to gravity and lower guide 21, whereby sheet A is separated from lower guide 21 preventing sheet A from being attracted to lower guide 21 due to the influence of static electricity.

Then, sheet A is discharged from conveyer belt portion and falls due to gravity, sheet sensor 41 is turned off because sheet A separates from actuator 44. As shown in FIG. 4B, wind intensity regulator 40 is then activated to cause blower port 35 to be fully closed, thus no wind W blows into turning chamber 11 through duct 34. Therefore, when the sheet is discharged, it is possible to smoothly invert the sheet without experiencing adverse effects: otherwise the sheet might be blown away if it is set curled or receive other adverse effects.

Here, fan 33 may be activated in synchronism with the timing of the operation of conveyer belt portion. Alternatively, fan 33 can activated in time with the operation of wind intensity regulator 40. The latter configuration can shorten the time of operation of fan 33 reducing the consumption of power.

(Third embodiment)

Figure 5A:
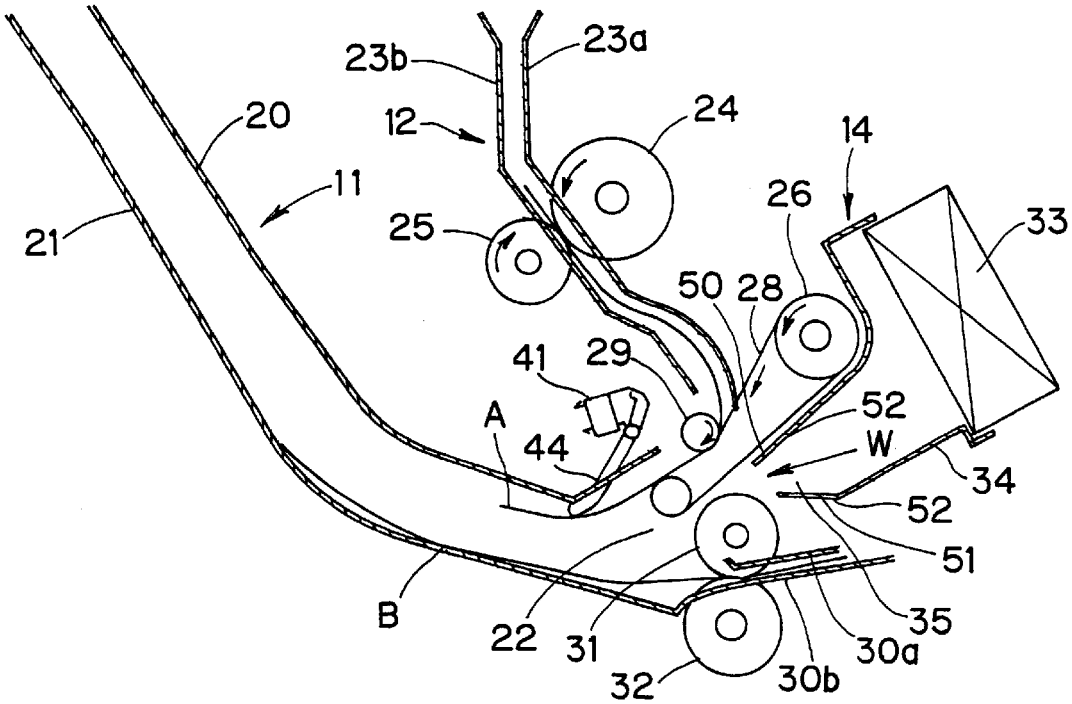
FIG. 5A is a configurational view showing a sheet inverting device in accordance with a third embodiment of the invention, where a sheet is inputted into the device.
Figure 5B:
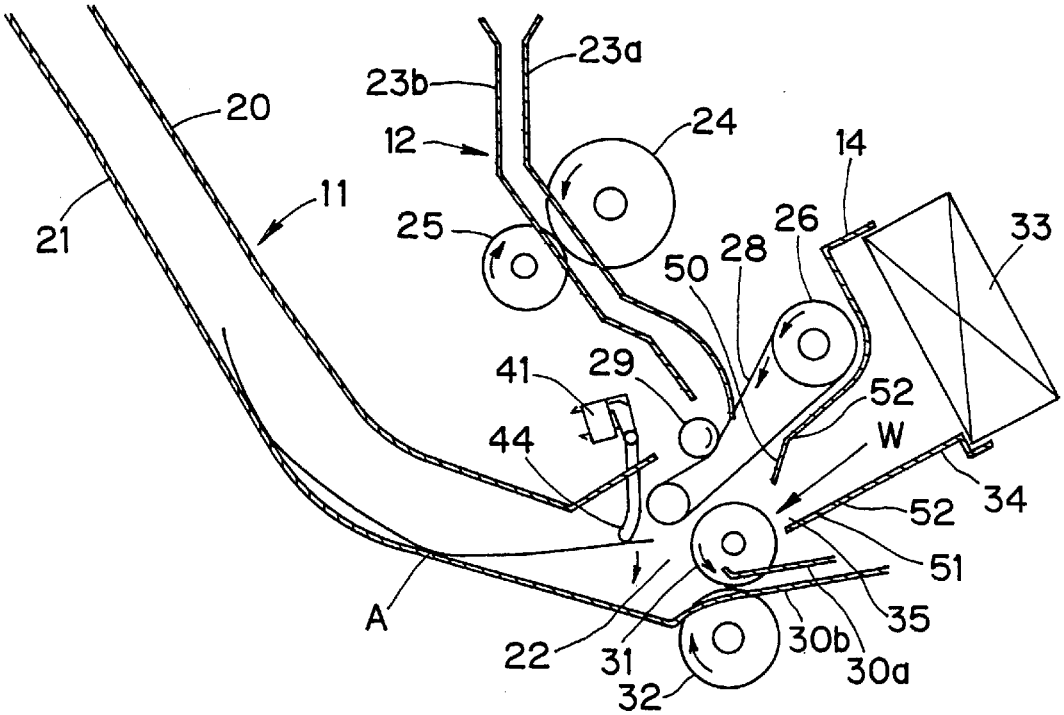
FIG. 5B is a configurational view showing a sheet inverting device in accordance with a third embodiment of the invention, where a sheet falls due to gravity.

In this embodiment, as shown in FIGS. 5A and 5B, a vertical wind direction changing mechanism for changing wind in the vertical direction is provided at blower port 35 of duct 34. The operation of the vertical wind direction changing mechanism is controlled based on the output signal from sheet sensor 41 for detecting the conveyance of sheet A. Other configurations are the same as those in the first embodiment.

The vertical wind direction changing mechanism comprises upper and lower flaps 50 and 51 disposed near blower port 35 of duct 34. These flaps are pivotably supported at duct 34 by supports 52 such as axes or hinges and are connected to a solenoid or a motor through gears, so that upper flap 50 can be rotated downwards and/or lower flap 51 can be rotated upwards. When sheet sensor 41 detects sheet A and is turned on, lower flap 51 rotates upwards to direct the wind upwards. When sheet sensor 41 is turned off, upper flap 50 rotates downwards to direct the wind downwards. In this case, fan 33 is operated regardless of the on-off state of sheet sensor 41.

By this mechanism, when the preceding sheet B is discharged from turning chamber 11 and the following sheet A is inputted into turning chamber 11, two sheets A and B pass each other in turning chamber 11. In such a case, or in the case where a large-sized sheet or thin sheet is inputted into turning chamber 11, as sheet sensor 41 is turned on, lower flap 51 is rotated upwards as shown in FIG. 5A so that wind W from fan 33 is blown out upwards or toward upper guide 20. Then, wind W blows concentratively to the underside of sheet A discharged from the conveyer belt portion, thus making it possible to reliably separate the preceding sheet B residing below sheet A or reliably separate a large-sized sheet or thin sheet from lower guide 21. As a result, it is possible to prevent occurrence of sheet jamming which would be caused when the sheets roll up one another.

Then, when sheet A is discharged from conveyer belt portion and falls due to gravity in turning chamber 11, sheet sensor 41 is turned off because sheet A separates from actuator 44. As shown in FIG. 5B, upper flap 50 is then rotated downwards so that wind W from fan 33 is blown out downwards or toward lower guide 21. Wind W is also blown across the upper side of sheet A falling, thus promoting the falling of the rear end of sheet A. Therefore, sheet A reaches lower guide 21 quickly so that it is possible to deliver out sheet A from turning chamber 11. This results in reduction of the time of the inverting operation thus improving efficiency of the invention. Further, even if the sheet is curly, it is possible to press the sheet down by the air blow. Therefore, it is possible to reliably discharge the sheet without affecting the invention of the sheet, achieving smooth inversion.

It is also possible to change the direction of wind upwards or downwards in a similar manner by using a butterfly valve for wind intensity regulator 40 used in the second embodiment and changing the angle of its valve 43.

(Fourth embodiment)

Figure 6A:
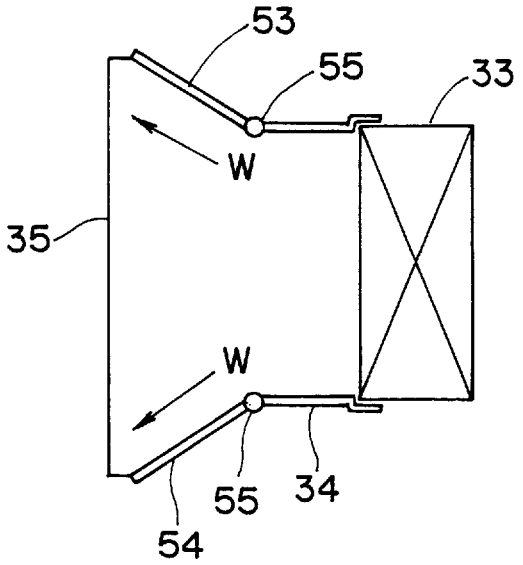
FIG. 6A is a view showing a fourth embodiment where the side wall of the duct is open.
Figure 6B:
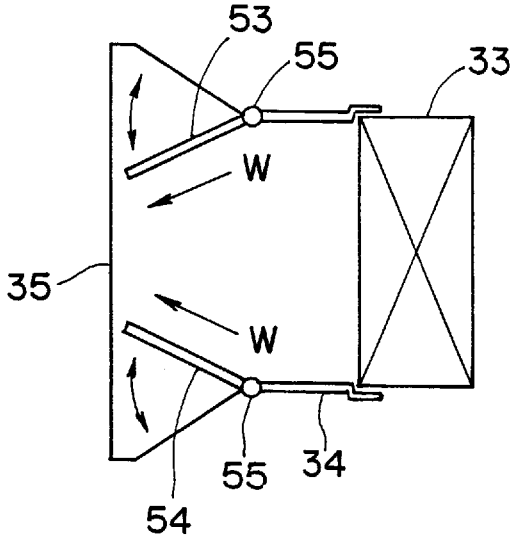
FIG. 6B is a view showing a fourth embodiment where the side wall of the duct is closed.

In this embodiment, as shown in FIGS. 6A and 6B, a wind changing mechanism for changing wind in the sheet width direction is provided at blower port 35 of duct 34. The operation of the wind changing mechanism is controlled based on the output signal from sheet sensor 41 for detecting the conveyance of sheet A. Other configurations are the same as those in the first embodiment.

The wind direction changing mechanism comprises side flaps 53 and 54 disposed near blower port 35 of duct 34. These flaps are pivotably supported at duct 34 by supports 55 such as axes or hinges and are connected to a solenoid or a motor through gears, so that the two flaps 53 and 54 can be rotated to be horizontally open or closed. When sheet sensor 41 detects sheet A and is turned on, side walls 53 and 54 open outwards as shown in FIG. 6A to broaden the range of the wind. When sheet sensor 41 is turned off, side walls 53 and 54 open inwards as shown in FIG. 6B to make the range of the wind narrow. In this case, fan 33 is operated regardless of the on-off state of sheet sensor 41.

By this mechanism, when the preceding sheet B is discharged from turning chamber 11 and the following sheet A is inputted into turning chamber 11, two sheets A and B pass each other in turning chamber 11. In such a case, or in the case where a large-sized sheet or thin sheet is inputted into turning chamber 11, as sheet sensor 41 is turned on, side flaps 53 and 54 open so that wind W from fan 33 is blown out being broaden across the sheet width direction. Then, wind W blows across the whole part of the underside of sheet A as it is being inputted, enabling the maximum use of wind W. As a result, it is possible to reliably separate the preceding sheet residing below the inputted sheet A or reliably separate a large-sized sheet or thin sheet from the lower guide. As a result, it is possible to prevent occurrence of sheet jamming which would be caused when the sheets roll up one another.

Then, when sheet A is discharged from conveyer belt portion and falls due to gravity in the turning chamber 11, sheet sensor 41 is turned off because sheet A separates from actuator 44. The two flaps 53 and 54 then close to make the blower port 35 of duct 34 narrow so that wind W from fan 33 is blown out toward the center with respect to the sheet width direction. Wind W is also blown across the upper side of sheet A falling, thus promoting the falling of the rear end of sheet A. Therefore, sheet A reaches lower guide 21 quickly so that it is possible to deliver out sheet A from turning chamber 11. This results in reduction of the time of the inverting operation thus improving efficiency of the inversion. Further, even if the sheet is curly, it is possible to press the sheet down by the concentrated air blow. Therefore, it is possible to achieve smooth inversion without blowing away the sheet or without adversely affecting the inversion of the sheet.

In this embodiment, when a sheet is inputted, the opening angles of side flaps 53 and 54 are adjusted in accordance with the sheet size in such a manner that side flaps 53 and 54 open wide apart for a wide sheet, and that side flaps 53 and 54 are adjusted to narrow the opening for a narrow sheet. In this way, as opening area of the blower port 35 of duct 34 can be varied in accordance with the sheet size, it is possible to effectively blow air to the sheet. That is, it is possible to prevent air from rounding from the sides of the sheet to the upper side thereof, without causing the sheet to be made turbulent in its posture.

Figure 7:
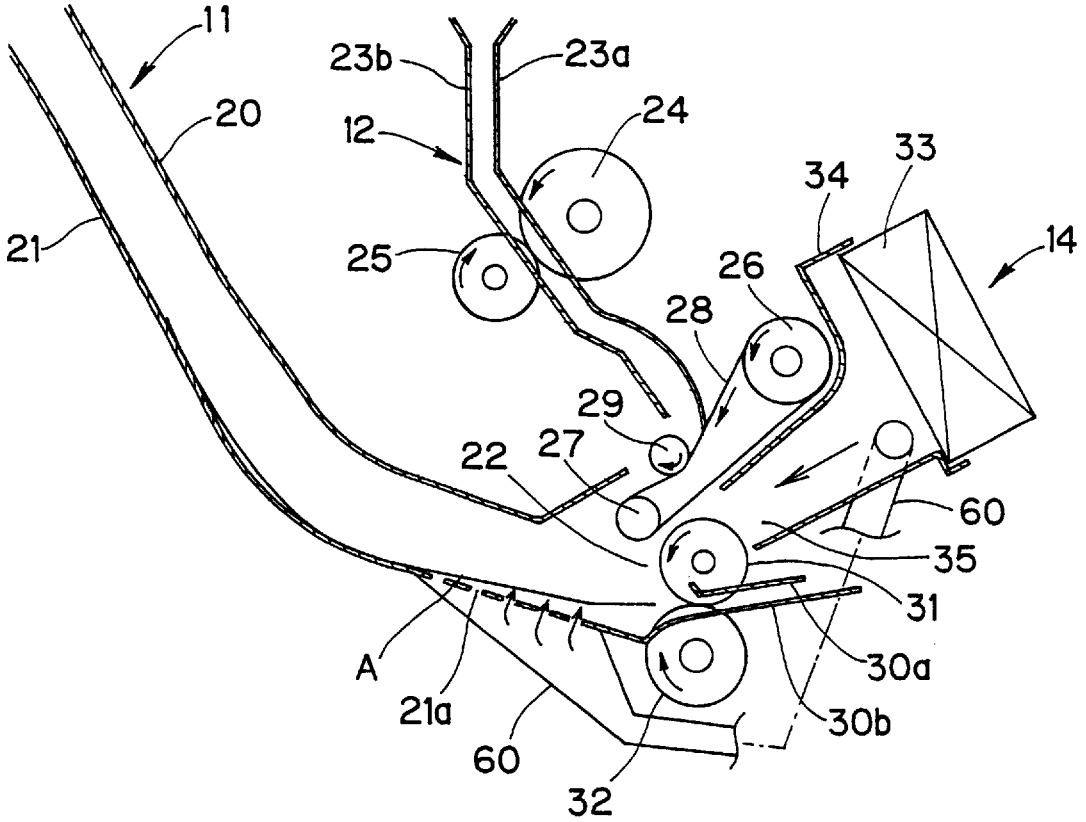
FIG. 7 is a configurational view showing a sheet inverting device in accordance with another embodiment.

The present invention should not be limited to the above embodiments and it is of course possible to add many modifications and changes to the above embodiments within the scope of the invention. For example, as shown in FIG. 7, the side wall of duct 34 and lower guide 21 may be connected by a branch tube 60 so that wind W can be blown out from perforation 21*a* formed in lower guide 21. By this configuration, sheet A having fallen on lower guide 21 is lifted up by wind W from the bottom forming an air layer between lower guide 21 and the sheet, thus preventing the sheet from being attracted to lower guide 21 due to static electricity. Further, since the rear end of sheet A can be raised slightly, this facilitates the sheet to be drawn into the discharging roller portion.

Louvers which can open and close may be provided at the blower port of the duct so as to change the direction of the wind above and below or in the sheet width direction. Further, it is possible to adjust the wind intensity in accordance with the size of the sheet by controlling the rotating rate of the fan or by changing the area of opening of the blower port by opening or closing louvers and side walls. Thus, it is possible to achieve stable inversion of the sheet without causing the sheet in the turning chamber to be made turbulent in its posture.

A butterfly valve may be provided at the blower port of the duct while the side walls of the duct may be adapted to open and close. In this case, it is possible not only to change the direction of wind in the vertical direction and in the sheet width direction, simultaneously but also adjust the intensity of wind.

As has been apparent from the description heretofore, in accordance with the invention, the inputting means is arranged above the opening of the turning chamber so that the sheet inputted from the inputting means can fall into the turning chamber due to gravity and be accommodated therein, and the discharging means is disposed below the opening of the turning chamber while the air blowing means for blowing air across the undersurface of the sheet inputted to the turning chamber is provided. Therefore, it is possible to separate the discharged sheet from the inputted sheet in the turning chamber by the air layer created by the blown air. Accordingly, the sheets passing each other will not rolls up to prevent occurrence of sheet jamming. As a result, the interval of sheets can be shorted, thus it is possible to achieve efficient inversion of the sheet.

When a large-sized sheet or thin sheet is inputted into the turning chamber, the tendency of the sheet to be attracted to the interior walls of the turning chamber due to static electricity, etc., can be prevented by the creation of the air layer. Therefore, it is possible to achieve highly reliable inversion regardless of what kind of sheet is used, without causing sheet jamming.

Moreover, since the sheet heated during fixing is blown with air, the sheet can be cooled and the solidification of toner can be promoted. This prevents toner from transferring to other sheets or components.

In particular, since in the sheet inverting device comprising a turning chamber composed of upper and lower guides arranged vertically with a gap in between wherein the lower guide is provided inclined forming a down slope toward the discharging means so that the sheet inputted can fall into the turning chamber due to gravity and can be accommodated therein, it is possible to reliably send wind across the underside of the sheet by placing the blower port of the duct from the blower means, between the inputting means and discharging means and directing it toward the lower guide. Thereby, it is possible to achieve the aforementioned effects and consequently a highly reliable sheet inverting device can be provided.

Since a wind intensity regulator for regulating the wind intensity is provided at the blower port of blowing means, it is possible to efficiently separate the sheet as it is being inputted, from the discharging sheet or the lower guide in the turning chamber. Further, when the sheet is falling due to gravity or when the sheet is discharged from the turning chamber, the inverting operation of the sheet can be prevented from being disturbed by adjusting the wind intensity. Thus, it is possible to achieve a reliable inverting operation of the sheet.

Further, since a vertical wind direction changing mechanism for changing wind in the vertical direction is provided at the blower port of the blower means, it is possible to efficiently prevent the sheet as it is being inputted, from touching the discharging sheet or components in the turning chamber. It is further possible to promote the falling of the sheet due to gravity. Accordingly, it possible to invert the sheet without causing sheet jamming even if the sheet is curly.

Moreover, since a wind changing mechanism for changing wind in the sheet width direction is provided at the blower port from the blower means, it is possible to reliably prevent the sheet as it is being inputted, from touching the discharging sheet or components in the turning chamber, by broadening the blowing range of wind.. It is also possible to promote the falling of the sheet due to gravity, by narrowing the blowing range of wind. Consequently, it possible to invert the sheet without causing sheet jamming even if the sheet is curly.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

What is claimed is:

1. A sheet inverting device comprising:

a turning chamber which temporarily holds a sheet for turning the sheet upside down;

an inputting means which conveys the sheet into the turning chamber;

a discharging means which takes the sheet out of turning chamber; and a blower means which sends air across the underside of the sheet as it is being inputted into the turning chamber, wherein the inputting means is disposed in the upper position of the opening of the turning chamber and the discharging means is disposed in the lower portion of the opening of the turning chamber so that the sheet as it is being inputted through the inputting means falls due to gravity and can be accommodated into the turning chamber, wherein the turning chamber is composed of upper and lower guides disposed vertically with a gap in between, the lower guide being inclined forming a down slope toward the discharging means, and the blower means is composed of a fan and a duct attached to the fan, the duct being disposed between the inputting means and discharging means with a blower port thereof directed to the lower guide.

2. The sheet inverting device according to claim 1, wherein a wind intensity regulator is provided at the blower port of the blower means.

3. The sheet inverting device according to claim 1, wherein a vertical wind direction changing mechanism for changing wind in the vertical direction is provided at the blower port of the blower means.

4. The sheet inverting device according to claim 1, wherein a wind changing mechanism for changing wind in the sheet width direction is provided at the blower port of the blower means.

5. A sheet inverting device comprising:

a turning chamber which temporarily holds a sheet for turning the sheet upside down;

an inputting means which conveys the sheet into the turning chamber;

a discharging means which takes the sheet out of turning chamber; and a blower means which sends air across the underside of the sheet as it is being inputted into the turning chamber, wherein the inputting means is disposed in the upper position of the opening of the turning chamber and the discharging means is disposed in the lower portion of the opening of the turning chamber so that the sheet as it is being inputted through the inputting means falls due to gravity and can be accommodated into the turning chamber, wherein a wind intensity regulator is provided at a blower port of the blower means.

6. A sheet inverting device comprising:

a turning chamber which temporarily holds a sheet for turning the sheet upside down;

an inputting means which conveys the sheet into the turning chamber;

a discharging means which takes the sheet out of turning chamber; and a blower means which sends air across the underside of the sheet as it is being inputted into the turning chamber, wherein the inputting means is disposed in the upper position of the opening of the turning chamber and the discharging means is disposed in the lower portion of the opening of the turning chamber so that the sheet as it is being inputted through the inputting means falls due to gravity and can be accommodated into the turning chamber, wherein a vertical wind direction changing mechanism for changing wind in the vertical direction is provided at a blower port of the blower means.

7. A sheet inverting device comprising:

a turning chamber which temporarily holds a sheet for turning the sheet upside down;

an inputting means which conveys the sheet into the turning chamber;

a discharging means which takes the sheet out of turning chamber; and a blower means which sends air across the underside of the sheet as it is being inputted into the turning chamber, wherein the inputting means is disposed in the upper position of the opening of the turning chamber and the discharging means is disposed in the lower portion of the opening of the turning chamber so that the sheet as it is being inputted through the inputting means falls due to gravity and can be accommodated into the turning chamber, wherein a wind changing mechanism for changing wind in the sheet width direction is provided at a blower port of the blower means.

* * * * *